US005974597A

United States Patent [19]

Conwell

[11] Patent Number: 5,974,597

[45] Date of Patent: Nov. 2, 1999

[54] PORTABLE AND COVERED TOILET

[76] Inventor: Dane B. Conwell, 519 Bower Hill Rd., Pittsburgh, Pa. 15228

[21] Appl. No.: 09/166,009

[22] Filed: Oct. 2, 1998

[51] Int. Cl.[6] ..... E03D 11/00

[52] U.S. Cl. ..... 4/432; 4/476; 4/431

[58] Field of Search ..... 4/321, 477, 476, 4/449, 460, 479, 482, 483, 484, 431, 432

[56] References Cited

U.S. PATENT DOCUMENTS

| | | | |
|---|---|---|---|
| 4,922,577 | 5/1990 | Harding et al. | 4/477 |
| 5,029,348 | 7/1991 | Boren | 4/476 |
| 5,088,134 | 2/1992 | Douglas | 4/484 |
| 5,282,281 | 2/1994 | Clear et al. | 4/434 |
| 5,500,962 | 3/1996 | Tagg | 4/476 |
| 5,557,810 | 9/1996 | Antos et al. | 4/321 |
| 5,615,420 | 4/1997 | Guyton | 4/233 |
| 5,671,487 | 9/1997 | Chen | 4/477 |
| 5,682,623 | 11/1997 | Fenoglio | 4/483 |

*Primary Examiner*—David J. Walczak
*Attorney, Agent, or Firm*—Kenneth P. McKay, Esq.

[57] ABSTRACT

A portable and covered toilet which can be easily assembled and used in a variety of remote locations that require proper waste disposal. An inexpensive flushing system maintains sanitary conditions, and, a cover, included to provide privacy, is folded onto the base, and the toilet is taken apart and situated thereon in a convenient, packaged unit.

4 Claims, 4 Drawing Sheets

PORTABLE AND COVERED TOILET

BACKGROUND OF THE INVENTION

1. Field of the Invention

The invention relates to a portable toilet that provides privacy of use in remote locations where a toilet facility may be otherwise unavailable or inconvenient, such as camping, sporting events or at picnics. The instant invention allows the use of a portable toilet that provides necessary privacy with an erectable cover and facilitates cleanliness through use of a flushing system. The toilet and cover outfit can be easily disassembled and transported. The disassembled toilet and cover is conveniently enclosed within a rectangular base and is stored as a lightweight unit in a box or other container.

2. Description of the Related Art

Many persons rely on portable toilets for camping, traveling, and tailgating at sporting events. Public portable toilets already in place may not be at a proximate location and may also be overcrowded and unsanitary. Some public areas may lack any facilities at all, resulting in the improper use of natural areas, to the detriment of the environment.

The Prior Art encompasses a variety of devices for the disposal of waste in portable toilets or containers. Units without flushing capability may employ the use of a bag or an assembled box. Upper chambers within these types of disposal means become unsanitary if not provided a means of cleaning and flushing the areas that come into contact with waste, however. Removal and disposal of waste is highly unpleasant.

Manual and electrically-powered portable flushing units have been demonstrated, but most are inordinately expensive; others do not accommodate privacy, particularly when employed by large groups of people. Complex pumping units have a tendency to be very heavy which prohibits ease of transportation, and toilets that have the capability of being transported and covered require assembly, a time-consuming requirement.

The present invention is directed toward overcoming the problems discussed above, particularly through features of cleanliness and privacy, while at the same time being collapsible, lightweight, and conveniently portable.

PRIOR ART

U.S. Pat. No. 5,682,623 (Fenoglio), Nov. 4, 1997, shows a portable, collapsible toilet made of a blank of foldable material and, when assembled in a rectangular configuration, a plastic bag may be nested between four side-by-side panels for waste collection.

U.S. Pat. No. 5,671,487 (Chen), Sep. 30, 1997, demonstrates a portable and mobile toilet including a case for removably placing a bowl therein, and having four elongate walls and an upper cover, collapsibly combined together. The upper cover is placed on the four walls when in use, and is closed on the case when collapsed. The four walls are made of a flexible opaque material, able to be rolled up and stored in the case when collapsed. Ropes and nails are provided to secure the upper cover and the case together for stability and to keep the toilet secured on the ground.

U.S. Pat. No. 5,615,420 (Guyton), Apr. 1, 1997, shows an apparatus for disposing of body waste in a portable toilet comprised of a container and an associated housing structure. Waste in the container is dumped into the toilet via a cable mechanism on the intake stroke of a hand pump. A water intake hose is manually lowered into the toilet water via a hose control handle prior to the operation of the pump.

While the container is in a vertical dumping position, the exhaust stroke of the pump forces water to be siphoned from the toilet and through a jet outlet to clean the interior of the container.

U.S. Pat. No. 5,557,810 (Antos, et. al.), Sep. 24, 1996, demonstrates a battery operated flush assembly for a portable toilet. The flush assembly includes a pump and motor mounted to the toilet's seat section. The battery pack supplies electrical power to the motor and includes an actuator, protected from inadvertent actuation within a recess, for electrically closing the circuit, thereby causing operation of the pump to discharge flush water into the bowl.

U.S. Pat. No. 5,282,281, (Clear, et. al.), Feb. 1, 1994, shows a compact, self-contained, portable vacuum toilet system having a sump for collecting waste liquids by means of gravity. A sink and its own push button-operated water valve may also be provided.

U.S. Pat. No. 5,088,134, (Douglas) Feb. 18, 1992, a portable toilet device, has a disposable waste receiving bag situated therein. The device is operable from an open or in-use position to a closed or non-use position, which causes rotation of the waste receiving bag to temporarily close and seal the bag.

SUMMARY OF THE INVENTION

The objective of the present invention is to provide a lightweight toilet that has a privacy cover. The toilet can be disassembled and the cover can be folded such that both are situated as a compact unit.

A secondary objective is to provide such portability that the resulting disassembled unit can be easily packaged and transported to a variety of locations for ready use.

A third objective is to provide quick and easy assembly of the toilet, and a simple erecting means for the cover thereby reducing the complexity and time needed to situate the toilet unit.

A fourth objective is to provide an inexpensive flushing device for the toilet such that all accessible areas of the toilet remain sanitary, and waste is properly contained during use.

A fifth objective is to provide a toilet that separates a lower waste-containment chamber that has a drain spout, and a waste-entrance chamber, thereby allowing for easy cleaning and disposal of waste from the toilet.

DETAILED DESCRIPTION OF THE PREFERRED EMBODIMENT

The invention will now be described in detail in relation to a preferred embodiment and implementation thereof which is exemplary in nature and descriptively specific as disclosed. As is customary, it will be understood that no limitation of the scope of the invention is thereby intended, and that the invention encompasses such alterations and further modifications in the illustrated device, and such further applications of the principles of the invention illustrated herein, as would normally occur to persons skilled in the art to which the invention relates.

Figure 1:
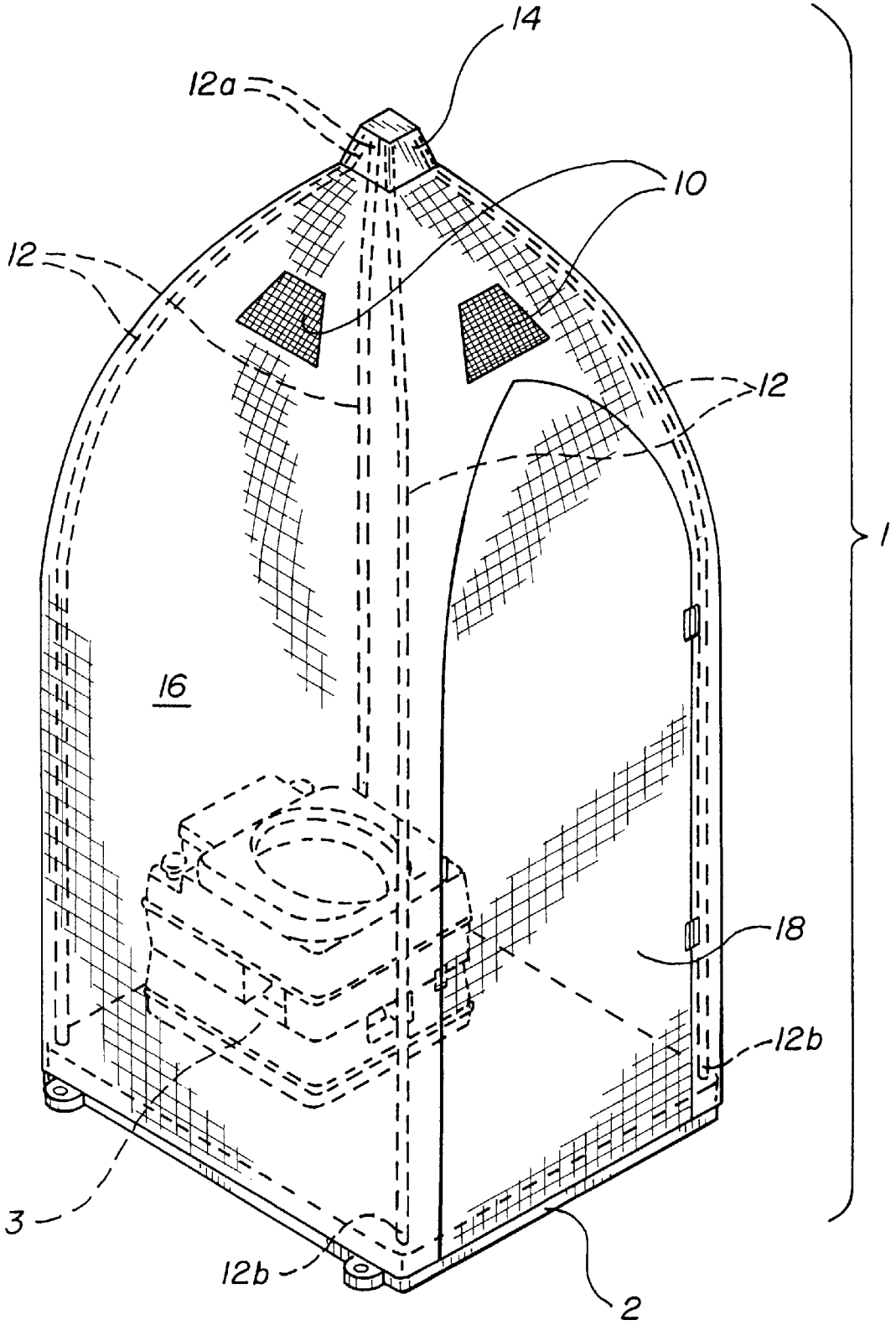
FIG. 1 is a perspective view of the portable toilet, fully erected and showing the pertinent subassemblies.

FIG. 1 shows the assembled portable toilet outfit 1 having a shielding cover 16 encompassing the portable toilet 3. "The shielding cover 16, adaptable to being folded, has a plurality of vents 10 and is erected using a plurality of tie rods 12 which have upper tips 12*a* that join at the upper tie rod guide 14 and lower tips 12*b* that vertically extend perpendicular to the base unit 2. The tie rods 12 are made of a lightweight and structural-supporting material such as plastic or aluminum. The portable toilet 3 sits in the base unit 2 and is accessible through the shielding cover entrance 18. Shielding entrance 18 is a door in the embodiment shown, but other alternatives may be encompassed, such as the use of a flap or separate cover, further simplifying the design.

Enabled by this simple and basic embodiment is the operation of the device as follows.

Figure 2:
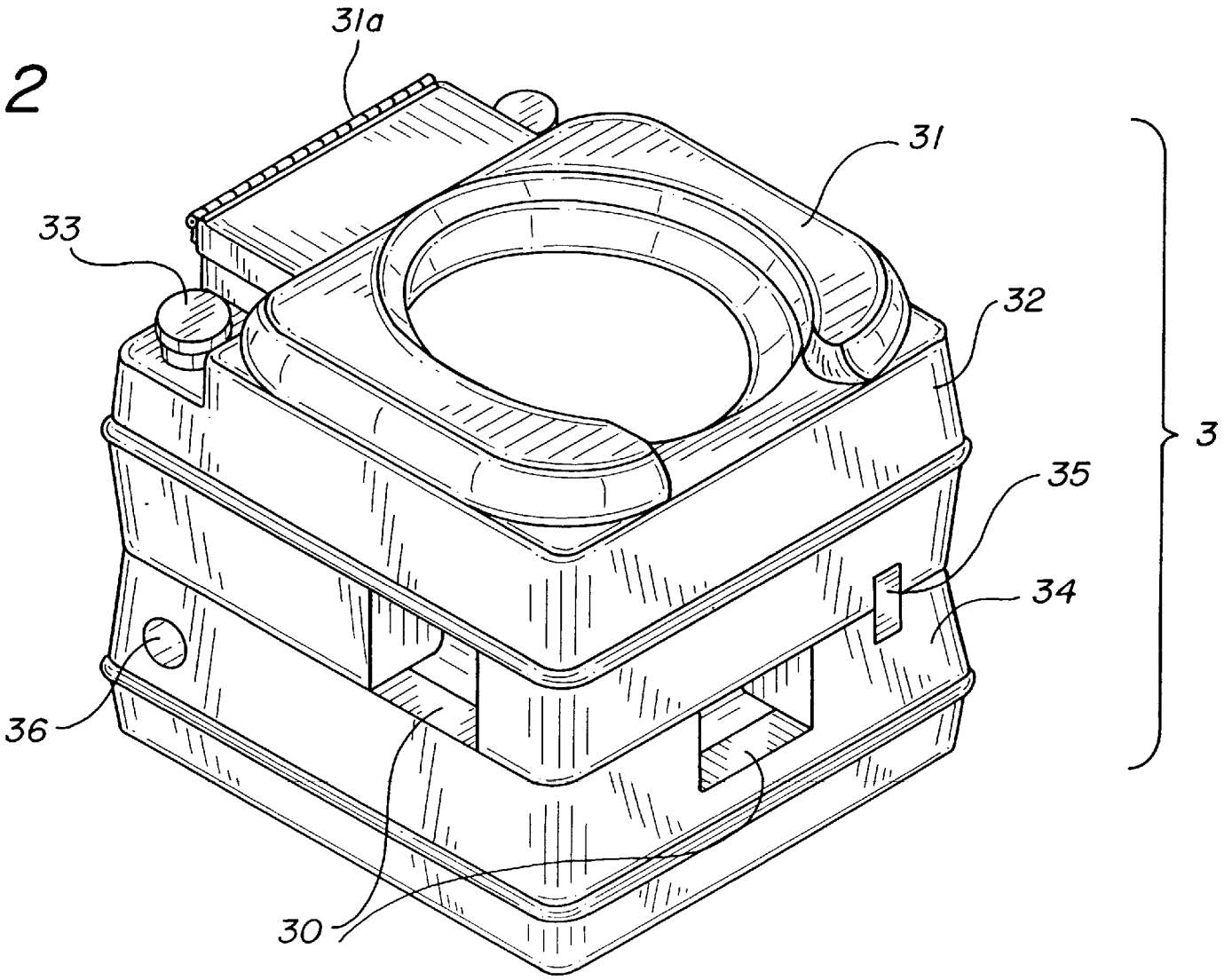
FIG. 2 is a perspective view of the toilet subassembly showing the constituent parts.

FIG. 2 shows the portable toilet 3 with a toilet top 32 mounted on a toilet bottom 34 by means of a section connector 35. The section connector 35 can be any type of clipping mechanism that is adapted to removing and securing the toilet top 32 to the toilet bottom 34. The toilet seat 31 may be raised by operation of a hinge 31*a* at the rear of the toilet seat 31 to accommodate use by a male. The toilet top 32 and the toilet bottom 34 have a pair of handles 30 that allow for easy carrying and separation of the two units. The toilet bottom 34 also has a low spout drain 36 by which solvent containing waste is emptied out of the toilet bottom 34 and sanitarily disposed of in proper facilities after transport from the area of use. FIG. 2 also shows a flushing actuator 33 at the rear of the toilet top 32 adapted to triggering the flushing of the portable toilet 3 by hand.

Figure 3:
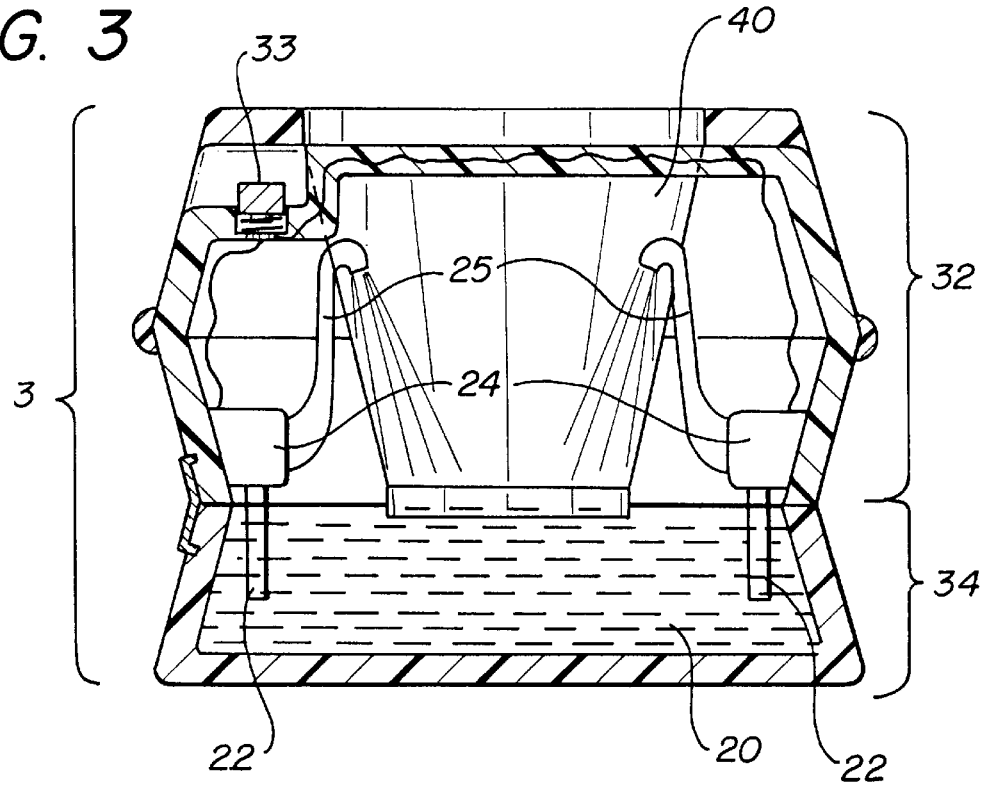
FIG. 3 is a cross sectional front view of the toilet subassembly showing the constituent parts contained therein.
Figure 5:
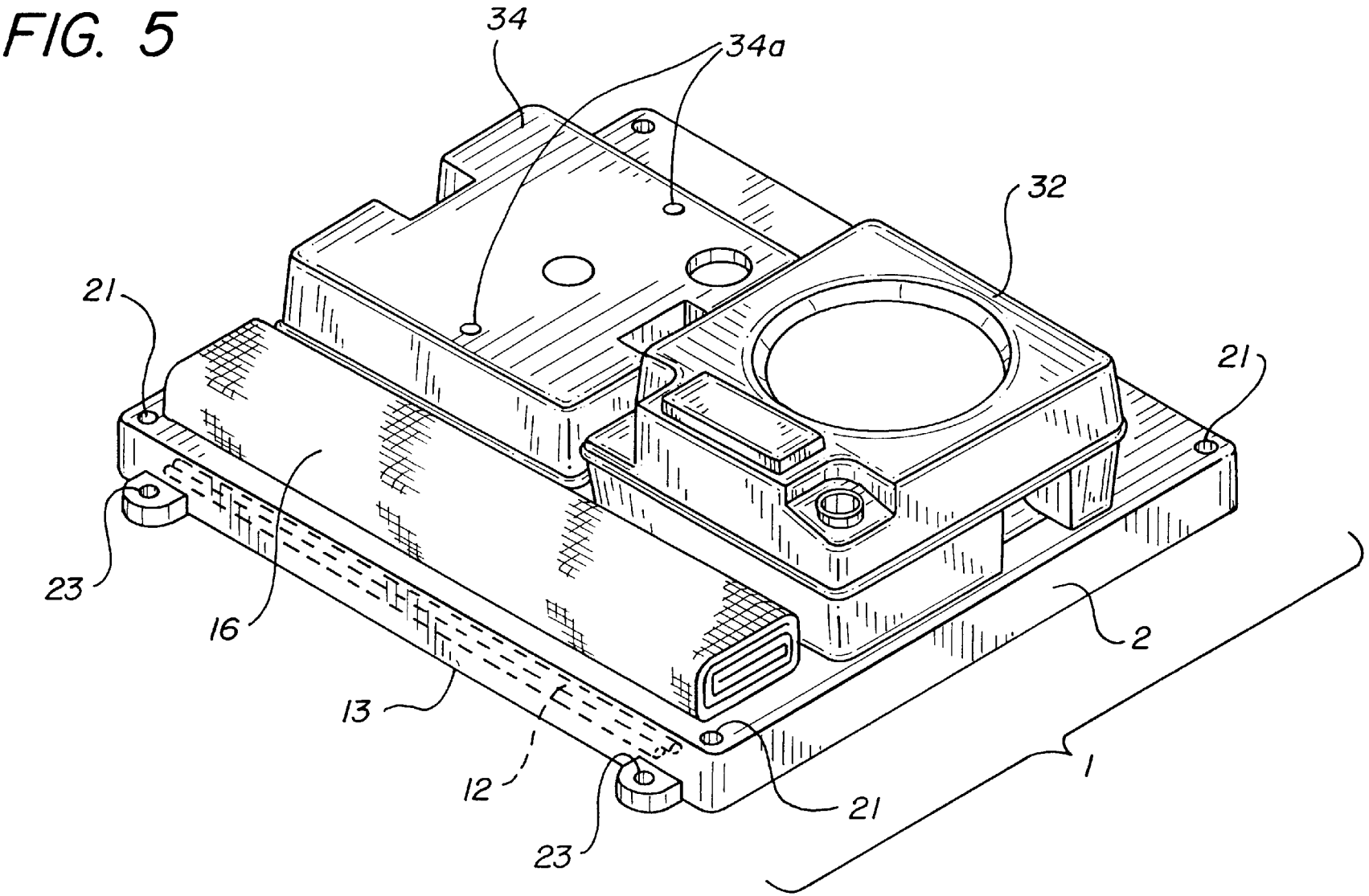
FIG. 5 is a perspective view of the portable toilet and privacy cover in a collapsed and stowable position.

FIG. 3 shows the cross section of the portable toilet 3 having a pair of battery operated pumps 24 located inside the top section inner surface 40 and on opposing sides of the toilet top 32. The flushing actuator 33 may be a switch or an actuating button that can be depressed by either hand or foot, depending on the positioning of the flushing actuator 33. Upon depression, the pumps 24 are electrically energized, producing a means for drawing up solvent 20 that is stored in the toilet bottom 34. Each solvent intake tube 22 penetrates the solvent 20 in the toilet bottom 34 by means of the two entry holes 34*a* (FIG. 5). The solvent 20 is dispersed through a solvent intake tube 22 which is downwardly disposed from the pumps 24. The solvent 20 is then exhausted from a solvent jet 25 upwardly disposed from the pumps 24. The solvent 20 is exhausted at such a force and at such an angle that it is capable of cleaning a maximum surface area of the top section inner surface 40.

Figure 4:
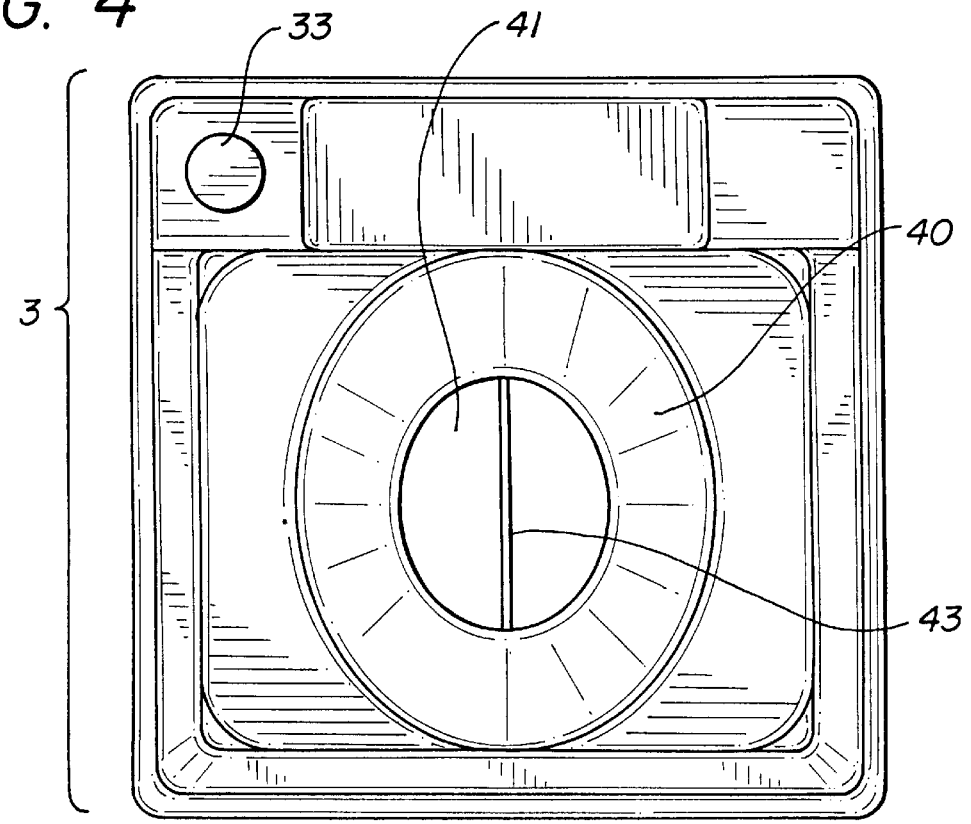
FIG. 4 is a top view of the portable toilet.

FIG. 4 is a top view of the portable toilet 3 showing a position of the flushing actuator 33 and the top section inner surface 40. The top section inner surface 40 is formed in a shape having a relatively flat slope, or concave-shaped, or similarly disposed toward the toilet bottom entrance 41, which has a smaller diameter than the top of the portable toilet 3. The toilet bottom entrance 41 also includes a flap 43 that remains shut until the portable toilet 3 is flushed, whereupon the flap 43 raises to vertical to allow solvent and waste to pass through the toilet bottom entrance 41.

FIG. 5 is a view of the portable toilet outfit 1 collapsed as a disassembled unit which is easily made compact and portable. The shielding cover 16 is folded and positioned on the base unit 2. The toilet top 32 rests on the base unit 2 after being disconnected from the toilet bottom 34. The plurality of tie rods 12 are removed from a plurality of tie rod holes 21 which are bored into the base unit 2. The tie rods 12 are then placed in an underlying compartment 13 on the underside of the base unit 2. Also shown in FIG. 5 are fixation holes 23 as a means for fixing the base unit 2 to the ground using weights or stakes.

I claim:

1. A portable, covered toilet, for containing liquid waste having a flushing system employing a cleaning solvent and which is conveniently sanitary, and easily made compact by a user for transport and storage, comprising:

(a) a rectangular, box-like base having four corners, and a cylindrical hole proximate to each of said corners, and having a rectangular, integral, hollow compartment therein, and having a means for securing said base.

(b) a toilet subassembly, comprising:

(i) a four-sided, hollow lower section having a rectangular lower section top, and a rectangular lower section bottom, said lower section having a capacity for said solvent and said liquid waste, and having an outlet from said lower section bottom whereby said solvent can be manually drained through the flow caused by gravity from said lower section, said lower section bottom adapted to sit on said base, said lower section top having a centrally located cylindrical opening, and a pair of entry holes, each of said entry holes disposed at an opposing side of said lower section top, positioned axially to said cylindrical opening;

(ii) a four sided upper section adapted to rest on said lower section having an outer shell and an inner housing, said inner housing having a trunconical outer surface, said surface having mounted thereon two electrical pumps disposed against said outer shell, each of said pumps having a solvent intake tube downwardly disposed therefrom adapted to fit through each of said entry holes and access said solvent, and each of said pumps having a solvent jet tube disposed upwardly therefrom, each of said jet tube having an exit, and each of said exit protruding from said outer surface, said upper section having a flushing actuator adapted to enable each of said electrical pumps, whereby each of said pumps draws up solvent through said solvent intake tube and sprays said solvent up through said exit and down said outer surface, whereby said solvent mixes with said liquid waste and flows into said opening, thereby cleaning said outer surface, and having a circular flap covering said opening, and being hingedly attached thereto whereby said circular flap turns vertical upon actuation of said flushing actuator, thereby permitting said solvent and said liquid waste to enter said lower section, thereby isolating said upper section from said lower section;

(iii) a U-shaped toilet seat situated above said upper section having a back and a front, said seat fixed by a hinge, said hinge disposed at said back, whereby said toilet seat can be manually raised;

(c) a plurality of erectable, compactable tie rods, each of said rods having an upper tip and a lower tip, each of said lower tips adapted to fit into said holes, whereby said tie rods are adapted to be supportive, and each of said tie rods configured to permit storage in said compartment;

(d) a tie rod guide adapted to hold each of said upper tips, whereby said plurality of tie rods are placed in said plurality of holes and removably secured into said tie rod guide;

(e) a cover adaptable to being folded and situated on said base, and having a doorway, whereby said user can enter and exit through said doorway, and having a plurality of vents, and adapted to be supported by said tie rods, thereby said cover encompasses said toilet, thereby said privacy is maintained by said user;

(f) a means for removably fastening said upper section to said lower section thereby enabling disassembly of said upper section from said lower section; and, (g) a means for lifting said upper section from said lower section.

2. A portable, covered toilet as claimed in claim 1, further comprising, as a means for lifting said upper section from said lower section, at least one indentation disposed within said outer shell whereby said user can lift said upper section from said lower section and situate said upper section on said base.

3. A portable, covered toilet as claimed in claim 1, further comprising said plurality of erectable, compactable tie rods made from aluminum.

4. A portable, covered toilet as claimed in claim 1, further comprising said plurality of erectable, compactable tie rods made from plastic.

* * * * *